US009980882B2

(12) United States Patent
Barry et al.

(10) Patent No.: US 9,980,882 B2
(45) Date of Patent: May 29, 2018

(54) DISPOSABLE EMESIS BAG WITH COMFORT FEATURES

(71) Applicants: Sheila P. Barry, Los Gatos, CA (US); Cynthia Lynn Obuchi, Alameda, CA (US)

(72) Inventors: Sheila P. Barry, Los Gatos, CA (US); Cynthia Lynn Obuchi, Alameda, CA (US)

( * ) Notice: Subject to any disclaimer, the term of this patent is extended or adjusted under 35 U.S.C. 154(b) by 0 days. days.

(21) Appl. No.: 14/853,724

(22) Filed: Sep. 14, 2015

(65) Prior Publication Data

US 2016/0158114 A1 Jun. 9, 2016

Related U.S. Application Data

(63) Continuation-in-part of application No. 13/304,635, filed on Nov. 26, 2011, now abandoned.

(60) Provisional application No. 61/419,229, filed on Dec. 2, 2010, provisional application No. 61/486,616, filed on May 16, 2011.

(51) Int. Cl.
*A61J 19/00* (2006.01)

(52) U.S. Cl.
CPC ..... *A61J 19/00* (2013.01)

(58) Field of Classification Search
CPC . A61J 19/00; A61J 19/02; A61F 5/451; A61F 5/44; A61G 9/003; A47K 13/14; A47K 11/12; B65D 31/10; B65D 31/12; B65D 33/16; B65D 81/264
USPC ..... 383/121, 46, 57, 60, 42, 33, 61.1, 383/61.2–61.5, 91; 4/451, 456, 484; 206/204, 223
See application file for complete search history.

(56) References Cited

U.S. PATENT DOCUMENTS

| | | | | |
|---|---|---|---|---|
| 3,438,370 | A * | 4/1969 | Krantz, Jr. | A41D 13/1146 128/206.12 |
| 3,952,336 | A * | 4/1976 | Kunter | A61G 9/003 4/451 |
| 2002/0193762 | A1* | 12/2002 | Suydam | A61F 5/4556 604/327 |
| 2007/0084866 | A1* | 4/2007 | Saeugling | B65D 31/02 220/495.06 |
| 2007/0235352 | A1* | 10/2007 | Madson | B65D 33/25 206/226 |
| 2008/0029658 | A1* | 2/2008 | Vanbost | B65B 67/04 248/99 |
| 2008/0154219 | A1* | 6/2008 | Longo | A61J 19/00 604/327 |
| 2009/0255046 | A1* | 10/2009 | Carter | A47K 11/06 4/484 |
| 2011/0158563 | A1* | 6/2011 | Soletski | B65D 31/10 383/105 |

* cited by examiner

*Primary Examiner* — Jes F Pascua
*Assistant Examiner* — Matthew Theis
(74) *Attorney, Agent, or Firm* — Larisa Migachyov

(57) ABSTRACT

A disposable emesis bag comprising a soft cushioning material at the opening of the bag to improve the user's comfort while and after vomiting. The soft cushioning material can be attached only to the portions of the bag that come into contact with the user's nose or chin, or around the entire perimeter of the opening of the bag. The bag may be scented or odor-absorbing, and is preferably waterproof.

19 Claims, 3 Drawing Sheets

DISPOSABLE EMESIS BAG WITH COMFORT FEATURES

CROSS-REFERENCE TO RELATED APPLICATIONS

The present application is a continuation in part of U.S. application Ser. No. 13/304,635, filed Nov. 26, 2011, which claims the benefit of U.S. provisional patent application No. 61/419,229, filed Dec. 2, 2010, and U.S. provisional patent application No. 61/486,616, filed May 16, 2011, which are both incorporated herein by reference in their entirety.

FIELD OF THE INVENTION

The present invention relates generally to fluid containment bags and particularly to a disposable bag for collection and disposal of emesis.

BACKGROUND

There are many illnesses and conditions that cause vomiting. For example, pregnancy often causes morning sickness; cancer treatment often causes vomiting; and many healthy people become nauseated to the point of vomiting in moving vehicles such as buses or airplanes. In many cases, the episode of vomiting can occur in a public place with no way for the sufferer to get to a bathroom, which adds humiliation to the distress of being sick.

To help people cope with this problem, many types of emesis bags exist on the market. Typically, these are disposable paper or plastic bags that can contain the vomitus long enough to enable the patient to get to a suitable disposal location. Such a bag can be placed in the seat pocket of an airplane for a passenger, or carried on one's person if one is pregnant or afflicted with an illness that causes frequent vomiting. The most common design for a disposable emesis bag is a plastic-coated paper bag with a rectangular bottom; this is the typical air-sickness bag. Some such bags, such as the one described in U.S. application Ser. No. 11/704,606 to Longo, come bundled with a kit that includes breath mints, moist towelettes, and other materials that can help a person clean themselves up after having vomited.

One of the issues that is not addressed by the disposable emesis bag design is the fact that holding a typical disposable emesis bag to one's face is not very comfortable for the user's nose or chin. While there are emesis basins and containers in existence that have specially shaped openings that conform to the user's face, those basins and containers are typically larger, less portable, reusable, and thus more suited for hospital use than for portability and easy disposal. For example, U.S. application Ser. No. 09/764,580 to Parker discloses an emesis container that has a funnel-shaped mouth area for conforming to the user's face. While such a funnel is more comfortable for the user than the opening of a paper bag, the container disclosed in the Parker application is too cumbersome to carry or to tuck into a seat pocket of an airplane.

Furthermore, a typical emesis bag typically does not provide any way to absorb or minimize the odors or sounds of vomiting, which can cause significant distress to the user and to those around the user.

A need therefore exists for a disposable emesis bag that is more comfortable to hold to one's face than a typical air sickness bag, but that is not more cumbersome, complex, or significantly more expensive to manufacture than a typical air sickness bag.

SUMMARY OF THE INVENTION

An object of the present invention is to provide an emesis bag that comprises cushioning material for the user's face.

Another object of the present invention is to provide an emesis bag that masks the odors of vomiting.

Another object of the present invention is to provide an emesis bag that comprises a pocket with comfort items such as a breath mint, gum, or a moist towelette.

The present invention comprises a disposable bag with a rectangular bottom, cushioning material attached to the open end of the bag, and a pocket attached to the exterior of the bag comprising a moist towelette, a mint, or a stick of chewing gum.

In an embodiment, the cushioning material is attached to the entire circumference of the interior of the opening of the bag.

In an embodiment, the cushioning material is attached to the interior of at least one gusset of the opening of the bag and there is no cushioning material attached to at least one other side of the open end.

The cushioning material is preferably polyethylene foam, but may be made of any other material with similar properties.

The bag is preferably made of paper, but may also be made of any other material with similar properties.

The cushioning material may be located in places where it contacts the user's chin, for greater comfort.

The gussets preferably can fold out so that the opening of the bag is larger than the rectangular bottom of the bag, and can fold in such a way as to enable the bag to fold into a compact package.

The material of the bag may absorb odors or emit a pleasant odor to mask the odors of vomiting.

In an embodiment, the bag comprises an insert located inside the bag that absorbs odors, absorbs fluids, or emits a pleasant odor.

In an embodiment, the cushioning of the bag may absorb odors or emit a pleasant odor.

The odor-absorbent material in the insert is preferably activated charcoal.

LIST OF FIGURES

DETAILED DESCRIPTION OF THE PREFERRED EMBODIMENT

Figure 1:
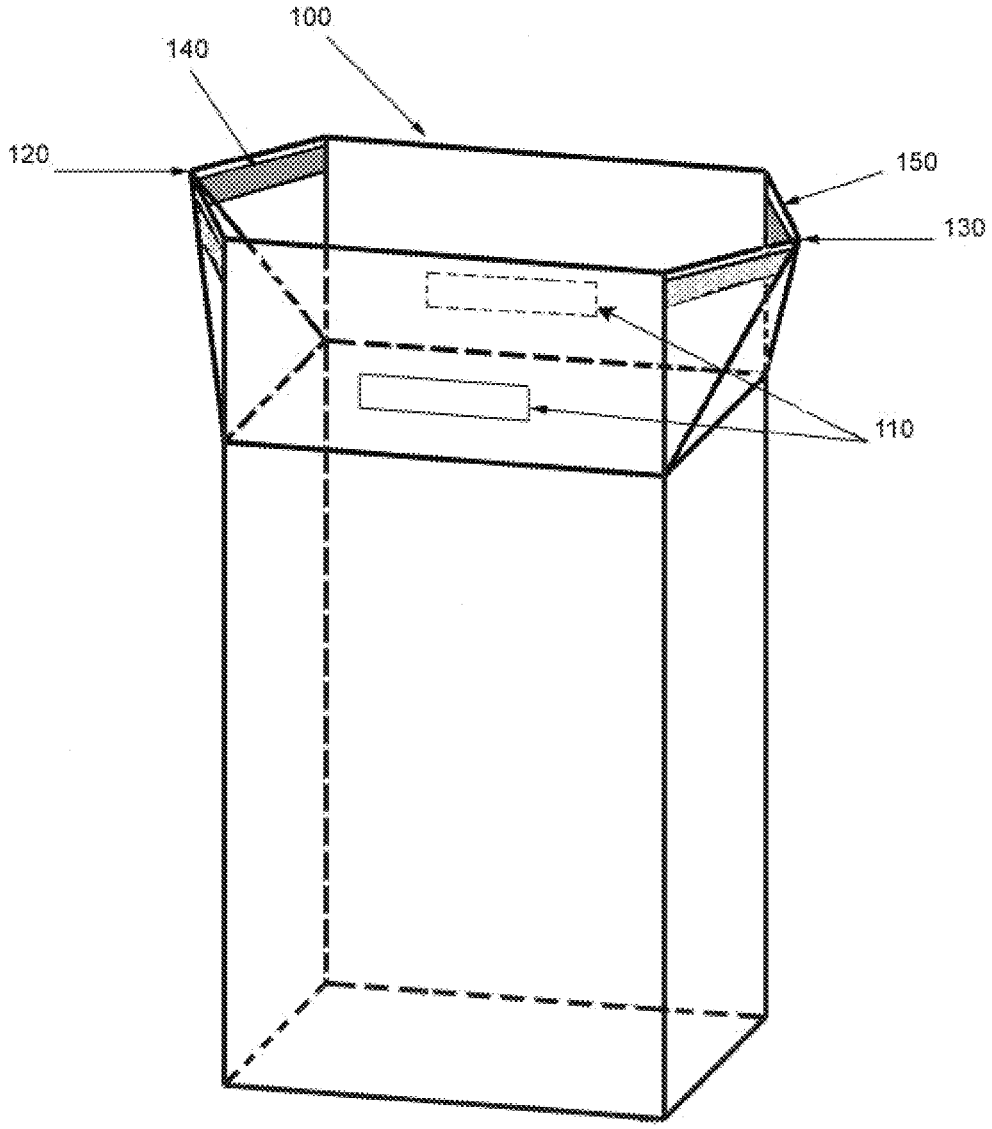
FIG. 1 shows one embodiment of the present invention, comprising a separate cushion for the nose and a separate cushion for the chin.

FIG. 1 shows one embodiment of the present invention. Bag 100 is a gusseted foldable bag with a rectangular bottom, preferably made of plastic-coated paper. The bag is made in such a way as to be impervious to water or other fluids for a long enough time period to enable the user to dispose of the bag and its contents safely. Velcro strips 110 enable the user to seal the bag after use. Gussets 120 and 130 are partially folded as mountain folds rather than valley folds so that the opening of the bag can better fit the user's face.

Cushions 140 and 150 are thin strips of soft material that are securely attached to gussets 120 and 130. In the preferred embodiment, the soft material is a polyethylene foam. When the bag is in use, cushion 140 contacts the user's nose and cushion 150 contacts the user's chin, or vice versa; this prevents the user's nose or chin from coming into contact with the edge of the paper bag. When the bag is folded, the cushions 140 and 150 are folded into the gusset; due to the compressibility of the material from which they are made, they do not add significant bulk to the folded bag.

Figure 2:
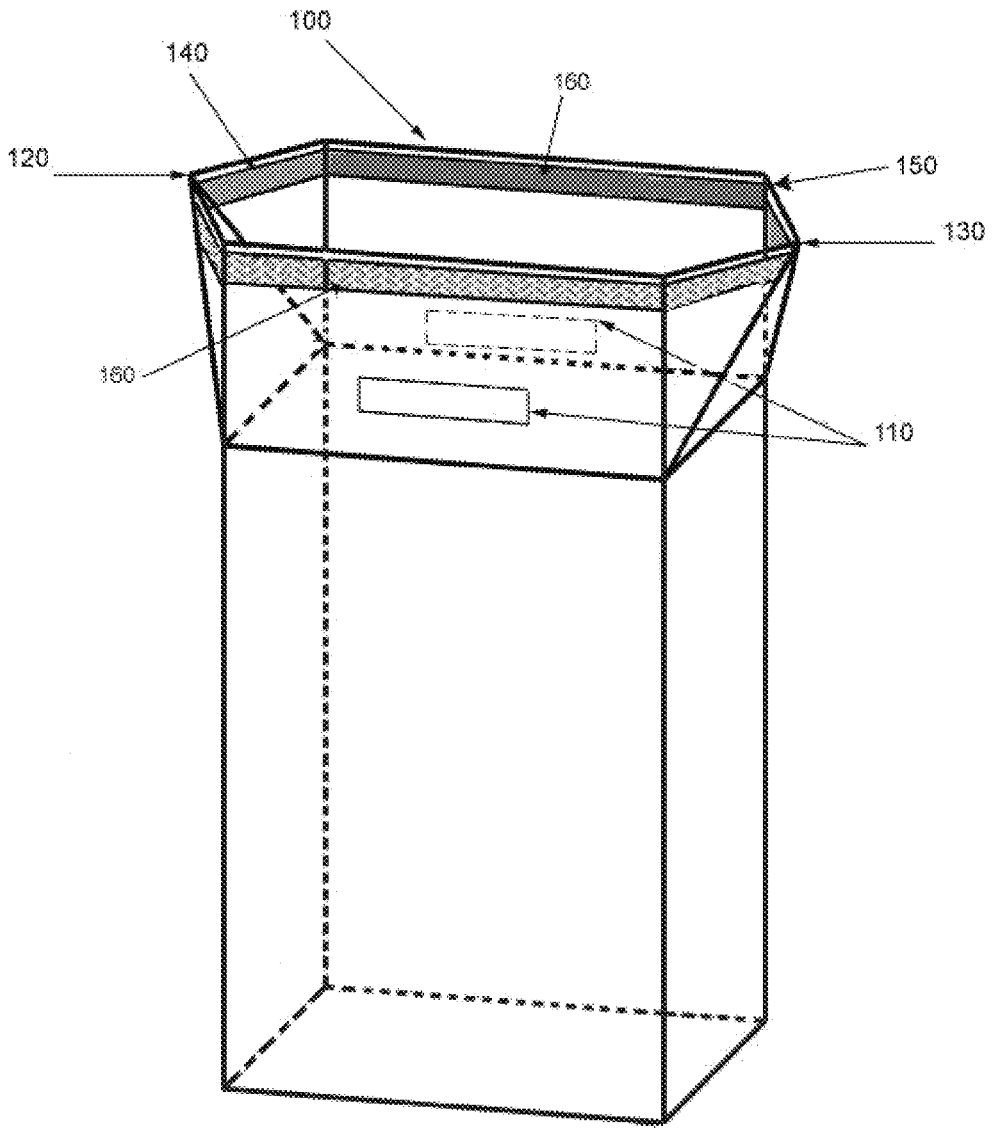
FIG. 2 shows an alternate embodiment of the present invention, comprising cushioning material all around the mouth of the bag.

FIG. 2 shows an alternate embodiment of the present invention. In that embodiment, cushion 160 is one strip of soft material that is securely attached all around the opening of the bag 100. When the bag is in use, the cushion 150 contacts the user's nose, chin, and cheeks; this provides more comfort for the user. Furthermore, due to the fact that the cushioning material fills more of the airspace between the user's face and the edge of the bag, distressing sounds and odors are less likely to be perceptible. When the bag is folded, cushion 160 is folded into the gusset, similarly to the cushions in FIG. 1.

Figure 3:
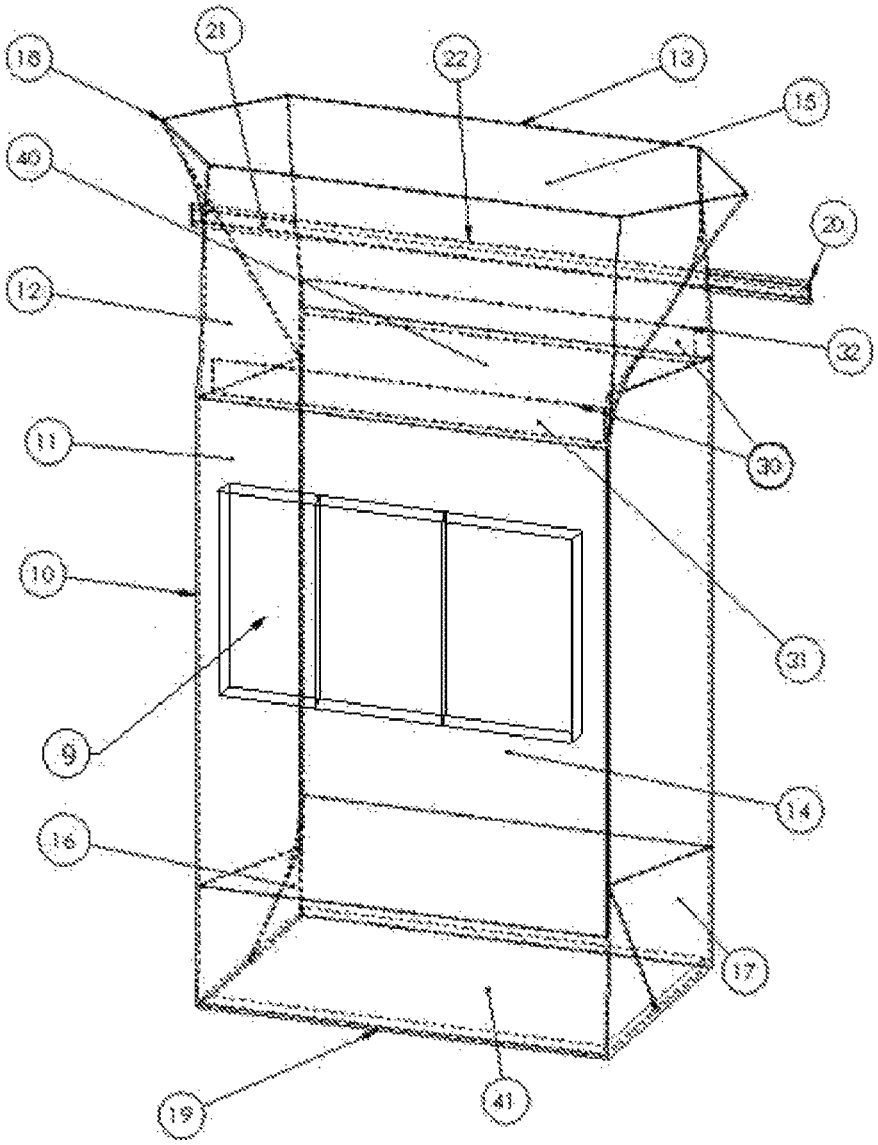
FIG. 3 shows an alternate embodiment of the present invention, comprising a pocket for accessories and a fastener for closing the bag.

As shown in FIG. 3, the bag also comprises a pocket 9 attached to the outside of the bag. The pocket preferably contains items like breath mints, a moist towelette, a stick of gum, or similar items that improve the user's comfort after vomiting. The pocket may be attached anywhere to the exterior of the bag, and is preferably attached to a non-gusseted side of the bag, as shown in the Figure.

In an embodiment, the bag itself may be scented with a pleasant odor that masks the odors of vomiting. For example, the paper material of the bag or the cushioning material may be impregnated with a minty scent or some other pleasant scent. Any non-toxic scent may be used for such a purpose, such as essential oils, synthetic scents, and similar substances.

In an embodiment, the bag or the cushioning may be treated with an odor-absorbing material such as baking soda or activated charcoal. This may be used in conjunction with scented material or on its own.

In an embodiment, an odor-absorbing, fluid-absorbing, or scented insert 41 may be placed inside the bag, as shown in FIG. 3. The insert is preferably sized in such a way as to fit into the rectangular bottom of the bag, and may comprise activated charcoal, baking soda, a scented material, a fluid-absorbent gel, or all of the above.

In an embodiment, the bag may be made of a waterproof or water-impermeable material, or paper treated with a waterproof coating or water-impermeable coating.

In an embodiment, the bag may comprise a twist tie 20 attached near the top of the bag that can be used for closing the bag after use, as shown in FIG. 3. Any other fastener, such as adhesives, Velcro, snaps, or a plastic zipper, may also be used for that purpose.

Exemplary embodiments have been described above. It will be understood that the present invention encompasses other embodiments and should be limited only by the appended claims.

The invention claimed is:

1. An emesis bag, comprising:

a disposable non-transparent bag having an exterior, a hollow interior, a bottom, four sides, and an open end, said open end comprising an edge, with said bottom sealed, with said bottom being rectangular, with at least two of said sides being gusseted and two of said sides being ungusseted;

cushioning material attached to the interior of said open end in such a way as to not cover the edge, said cushioning material at least partially coming into contact with a user's face when the emesis bag is in use;

an internal fastener attached to the interior of the disposable non-transparent bag below the cushioning material, said internal fastener comprising a first fastening element attached to a first ungusseted side and a second fastening element attached to a second ungusseted side, in such a way that the first fastening element fastens to the second fastening element;

an external fastener attached to the exterior of the disposable non-transparent bag, said external fastener comprising a twist tie of a length that is longer than the width of an ungusseted side of the emesis bag, wherein the twist tie is attached to an ungusseted side below the cushioning material parallel to the open end of the emesis bag in such a way that a first end of the twist tie and a second end of the twist tie extend outward beyond an edge of the ungusseted side;

wherein the opening is of a size that is sufficient to come into contact with a user's mouth, chin, and nose when the emesis bag is in use;

a pocket attached to the exterior of the disposable bag;

at least one of the following group inserted into the pocket:

i. a moist towelette;

ii. a mint;

iii. a stick of chewing gum.

2. An emesis bag as in claim 1, wherein said cushioning material is attached to the entire circumference of the interior of said open end.

3. An emesis bag as in claim 1, wherein said cushioning material is attached to the interior of at least one gusset on at least one side at the open end, and wherein there is no cushioning material attached to either ungusseted side at the open end.

4. An emesis bag as in claim 1, wherein said cushioning material is a polyethylene foam.

5. An emesis bag as in claim 1, where the bag is made of paper.

6. An emesis bag as in claim 3, wherein said cushioning material is attached to the interior of both of the gussets at the opening of the bag, and wherein at least one side of the bag is free of cushioning material.

7. An emesis bag as in claim 3, wherein said cushioning material is attached to the portions of the circumference of said open end where it contacts the user's chin.

8. An emesis bag as in claim 1, wherein the gusseted sides comprise an inner surface and an outer surface, and wherein the gussets can fold in such a way that a portion of the inner surface of the gusset is in close proximity to another portion of the inner surface of the gusset.

9. An emesis bag as in claim 1, wherein the gussets can fold in such a way as to enable the bag to fold into a compact package the size of the rectangular bottom.

10. An emesis bag as in claim 1, wherein the material of the bag absorbs odors.

11. An emesis bag as in claim 1, wherein the material of the bag emits an odor.

12. An emesis bag as in claim 1, further comprising:

a. an insert located inside the bag that absorbs odors.

13. An emesis bag as in claim 1, further comprising:

a. an insert located inside the bag that emits an odor.

14. An emesis bag as in claim 1, further comprising:

a. an insert located inside the bag that absorbs fluids.

15. An emesis bag as in claim 1, wherein the cushioning absorbs odors.

16. An emesis bag as in claim 1, wherein the cushioning emits an odor.

17. An emesis bag as in claim 12, wherein the insert comprises activated charcoal.

18. An emesis bag as in claim 1, wherein the disposable bag is waterproof.

19. An emesis bag as in claim 1, wherein the internal fastener is a hook-and-loop fastener.

* * * * *